US011571728B1

(12) United States Patent
Helfrich

(10) Patent No.: US 11,571,728 B1
(45) Date of Patent: Feb. 7, 2023

(54) ADJUSTABLE DIAMETER DIE ASSEMBLY

(71) Applicant: John M. Helfrich, McPherson, KS (US)

(72) Inventor: John M. Helfrich, McPherson, KS (US)

( * ) Notice: Subject to any disclaimer, the term of this patent is extended or adjusted under 35 U.S.C. 154(b) by 0 days.

(21) Appl. No.: 17/671,777

(22) Filed: Feb. 15, 2022

(51) Int. Cl.
*B21C 25/08* (2006.01)
*B21C 25/02* (2006.01)

(52) U.S. Cl.
CPC ..... *B21C 25/02* (2013.01); *B21C 25/08* (2013.01)

(58) Field of Classification Search
CPC ..... B21C 25/02; B21C 25/08; B21C 3/06; B21C 3/14; B21C 29/00; B21C 29/003
See application file for complete search history.

(56) References Cited

U.S. PATENT DOCUMENTS 3,564,884 A * 2/1971 Hinshaw ..... B21C 3/02 72/57
3,719,065 A * 3/1973 Fuchs, Jr. ..... B21C 31/00 72/263
3,782,154 A * 1/1974 Fuchs, Jr. ..... B21C 25/08 72/274
2014/0260487 A1* 9/2014 Funk ..... C22C 1/005 72/253.1

* cited by examiner

*Primary Examiner* — Gregory D Swiatocha
(74) *Attorney, Agent, or Firm* — Dale J. Ream

(57) ABSTRACT

An adjustable diameter die assembly for extruding a heated and malleable workpiece being forcefully moved downstream includes a die having a first ring and a second ring spaced apart from the first ring, the die having an axial portion extending intermediate the first and second rings that defines a throughbore having an axial diameter that is adjustable. The adjustable diameter die assembly includes a piston/cylinder combination operatively coupled to the die that, when actuated, causes (1) a compression of the first and second rings toward one another such that the axial diameter is decreased or (2) a stretching of the first and second rings away from one another such that the adjustable axial diameter is adjusted, respectively.

7 Claims, 9 Drawing Sheets

ADJUSTABLE DIAMETER DIE ASSEMBLY

BACKGROUND OF THE INVENTION

This invention relates generally to tooling and die devices and, more particularly, to an adjustable die assembly that can selectively increase or decrease a die's diameter and, accordingly, a diameter of a workpiece extruded through the die.

Extrusion is traditionally associated with forcefully pushing a superheated mass of metal, also referred to as a billet, downstream through a cooling tank and then through a die configured to shape the billet into a solid rod having a predetermined diameter or other shape depending on the shape of the die. Similarly, the same principles of extrusion may be used to form types of pipe and tubing having an outer wall defining a hollow interior space and a predetermined diameter. In fact, a preferred embodiment of the present invention describes extruding plastic tubing (that is hollow and cylindrical) although the tubing and process may work equally well for extruding a solid metal billet to a solid metal rod. Various techniques may be used to maintain the integrity of the hollow tube during the extrusion process and its diameter as the tube cools. The present invention is directed to a die having an adjustable diameter such that a workpiece drawn downstream through the die will share the adjusted diameter.

For further context, a traditional extrusion may be produced by pushing an aluminum billet heated to 600 degrees Celsius through a steel die. Tooling associated with the die and the heated billet may include a cooling tank for cooling the molten or superheated billet prior to its passage through the die. Aluminum is the most commonly extruded material and can be made into almost any shape imaginable. In other words, the shape of the die causes the heated metal billet to be shaped identically to the shape of the die. Obviously, the billet (i.e., the piece of aluminum) must be heated such that its shape configuration may be changed as it is pulled or pushed through the die. Most commonly, the die has a round or cylindrical configuration such that the extruded workpiece is rod that may be cut to size and used, such as in construction, as a plurality of rods each having an identical length and diameter. It is understood, however, that the die may be constructed of virtually any shape and size so as to extrude aluminum workpieces having the same shape and size.

Extruding tubing (having a hollow and open interior space) is accomplished in a similar manner although super heating the plastic stock of the eventual workpiece is less critical and requires less cooling via the cooling tank and less force or pressure for proper and intended formation of the workpiece by the die.

Various dies and associated tooling are known and commonly used to extrude metal and plastic. Although presumably effective their intended purposes, the existing dies or die assemblies do not include a structure or function capable of adjusting or varying its own diameter and, accordingly, a diameter of the extruded metal workpiece.

Therefore, it would be desirable to have an adjustable diameter die assembly for use in extruding a workpiece, such as tubing, whose own diameter is adjustable so as to cause a diameter of the extruded metal workpiece to be adjustably variable. Further, it would be desirable to have an adjustable diameter die assembly configured to adjustably increase or decrease its own diameter in direct response to a predetermined amount of pushing or pulling force exerted on the die, respectively. In addition, it would be desirable to have an adjustable diameter die assembly in which the pushing or pulling force may be exerted by a hydraulically or mechanically actuated piston that is operatively connected to the variable diameter die.

SUMMARY OF THE INVENTION

An adjustable diameter die assembly according to the present invention for extruding a heated and malleable workpiece being forcefully moved downstream first through a cooling tank having a volume of water for cooling the workpiece and then through an outlet opening defined by an outlet wall of the cooling tank. The adjustable diameter die assembly includes an adjustable die positioned downstream of and in communication with the outlet opening of the cooling tank, the adjustable die having a first ring and an axial portion extending between the first and second rings that defines a throughbore defining an axial diameter. The adjustable diameter die assembly includes a piston/cylinder combination operatively coupled to the adjustable die that, when actuated, selectively causes (1) a tightening, of the first and second rings toward one another such that the axial diameter is decreased or (2) a relaxing of the first and second rings away from one another such that the axial diameter is increased, respectively. Further, the throughbore defined by the adjustable die extrudes the workpiece according to the axial diameter when the workpiece is forcefully moved downstream through the throughbore of the adjustable die.

Therefore, a general object of this invention is to provide an adjustable diameter die assembly that is configured to increase or decrease its own diameter in response to a pushing or pulling force and, as a result, to increase or decrease a diameter of a workpiece that is pushed or pulled through the die, respectively.

Another object of this invention is to provide an adjustable diameter die assembly, as aforesaid, that includes a that includes a hydraulically actuated piston that is configured to apply the pushing or pulling force on the adjustable diameter die.

Still another object of this invention is to provide an adjustable diameter die assembly, as aforesaid, that is configured to vary its diameter by ±0.005 inches when the piston is actuated.

Yet another object of this invention is to provide an adjustable diameter die assembly, as aforesaid, in which the hydraulically actuated piston is computer-controlled based on sensor data.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1A:
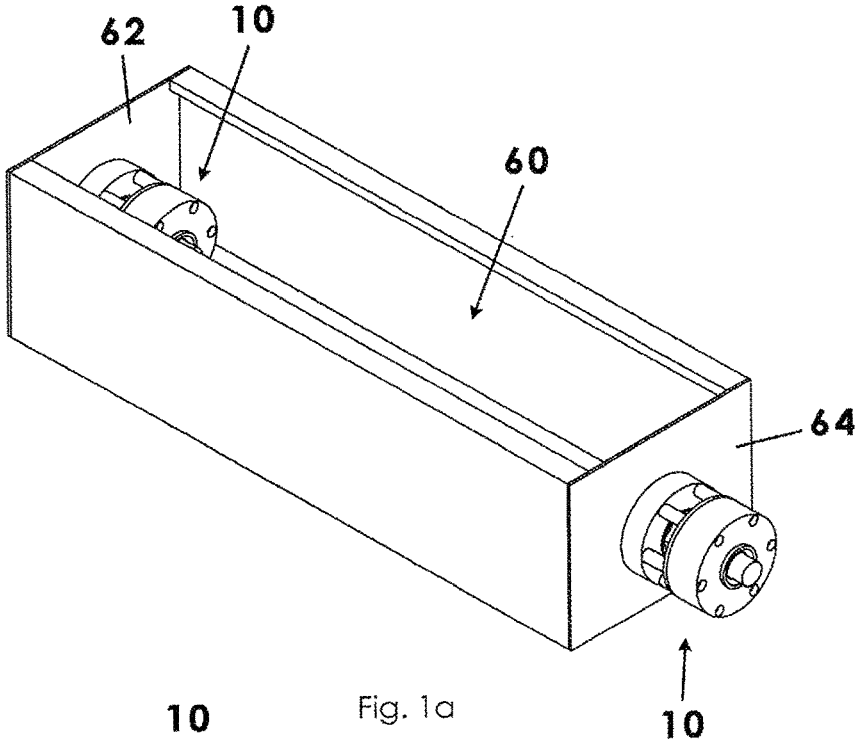
FIG. 1 is a perspective view of an adjustable diameter die assembly according to a preferred embodiment of the present invention, illustrated in use with associated tooling and containment tank arranged for an extrusion process.
Figure 1B:
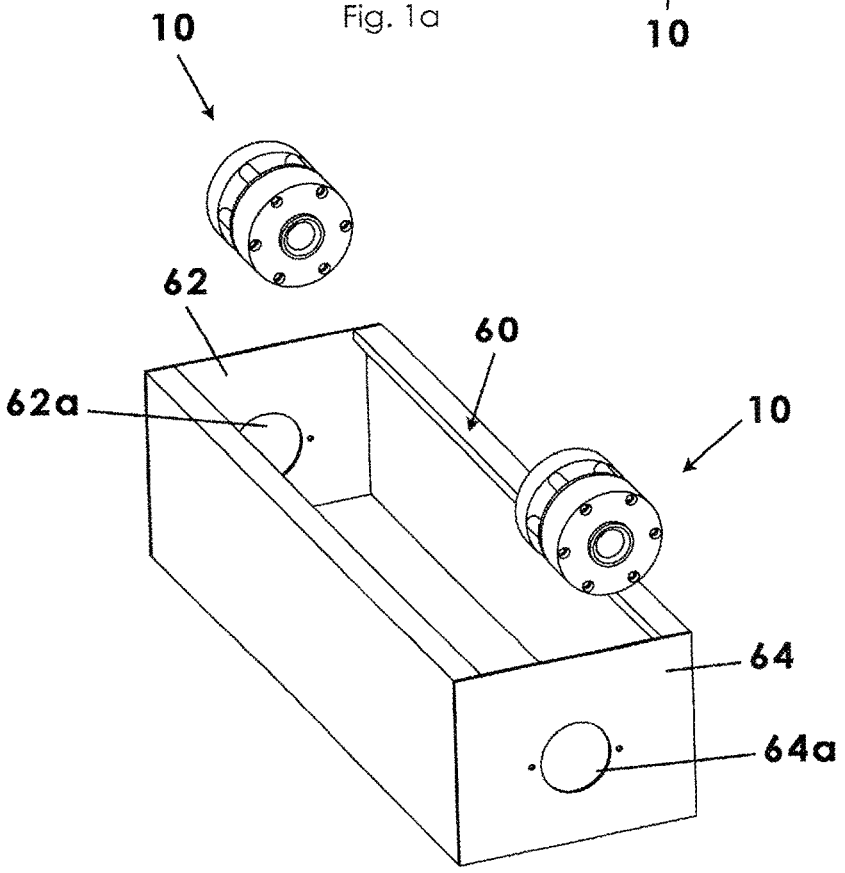
Figure 2:
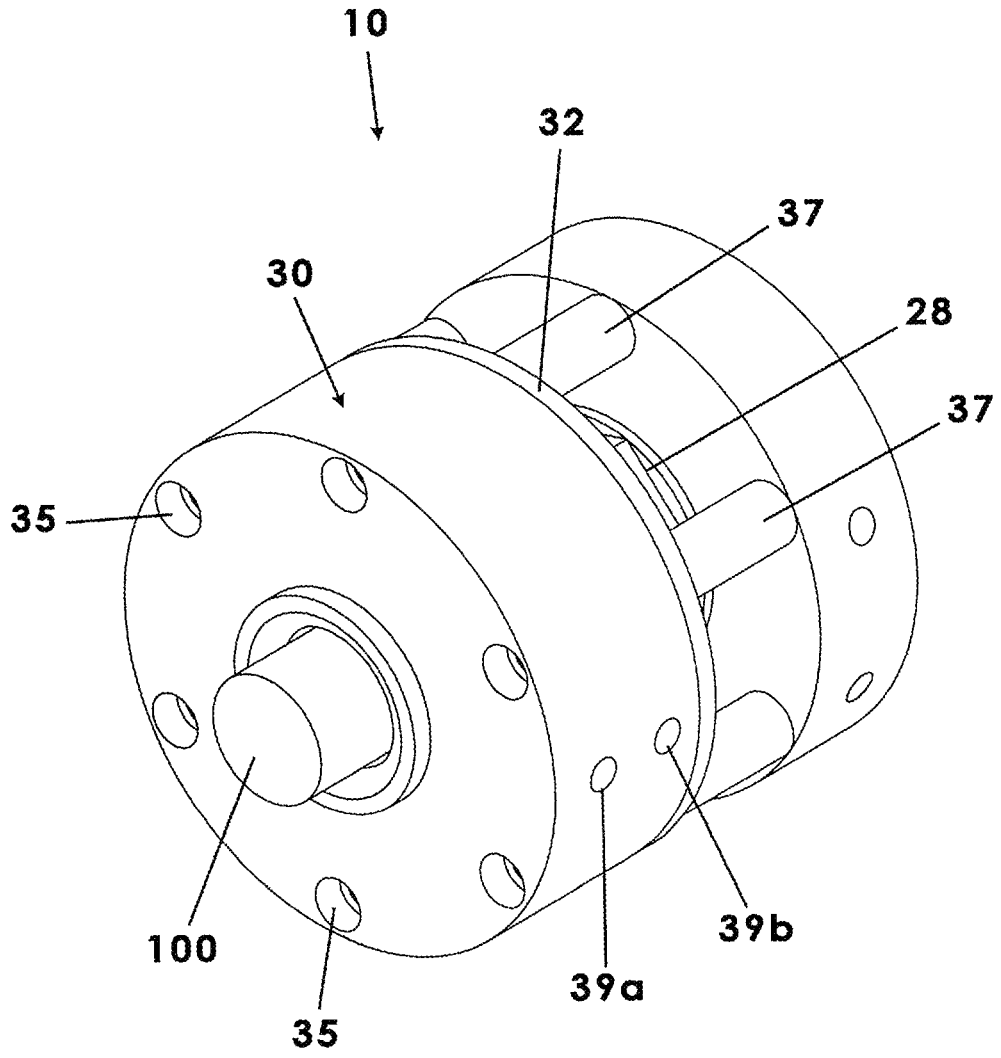
FIG. 2 is a perspective view of the adjustable diameter die assembly and associated tooling including a hydraulically actuated piston and the material as a solid rod being extruded according to one embodiment of the present invention.

An adjustable diameter die assembly according to a preferred embodiment of the present invention will now be described with reference to FIG. 1*a* to 7 of the accompanying drawings. The adjustable diameter die assembly 10 includes an adjustable diameter die 20, a hydraulic cylinder housing 30, hydraulic cylinder piston 40, a hydraulic cylinder end plate 32, and related tooling including a cooling container 60. Together, the adjustable diameter die assembly 10 enables a workpiece 100 (which may also be referred to as a billet) to have its diameter adjusted (selectively increased or decreased) as it is extruded by being pushed through the die.

First, tooling and other components common to an extrusion process will be discussed so as to provide context to the present invention. Generally, an extrusion process involves pushing a workpiece (a.k.a. an aluminum billet 100), such as a rod heated to 600 degrees Celsius through a steel die. Tooling associated with the die and superheated billet may include a cooling tank 60 for cooling the molten or superheated billet prior to its passage through the die. Even with a degree of cooling, the intention is that the aluminum billet is malleable to take the shape of the die when pushed therethrough. As shown, the cooling tank 60 (also referred to as a cooling container 60) defines an inlet end 62 having an inlet wall and an outlet end 64 having an outlet wall. And of course, a similar process may include extrusion of workpiece illustrated as a cylindrical tubing 100 that is in hollow in the center. The workpiece 100 shown as tubing is illustrated specifically in FIGS. 6*a* to 7 and uses the same reference numerals for like elements. The inlet end 62 may also be referred to as an upstream end using the same reference number; similarly, the outlet end 64 may also be referred to as a downstream end using the same reference number. The inlet wall may define an inlet opening and the outlet wall may define an outlet opening, both of which are dimensioned to receive the workpiece 100 therethrough and being in communication with a die assembly as described herein.

The workpiece 100 enters the cooling tank 60 via the inlet opening where it may be cooled somewhat by water contained within the cooling tank 60. In an embodiment, an adjustable diameter die assembly 10 may be positioned on an inner surface of the cooling tank 60 and aligned with the inlet opening so as to at least partially shape and extrude the billet, understanding that the diameter of the still superheated billet may expand or otherwise change as it is cooled by the water in the cooling tank 60. For clarity, the adjustable diameter die assembly 10 positioned adjacent the inlet end 62 may be referred to as an "auxiliary" die assembly. And of course, a similar process may include extrusion of a cylindrical tubing that is in hollow in the center.

Figure 5A:
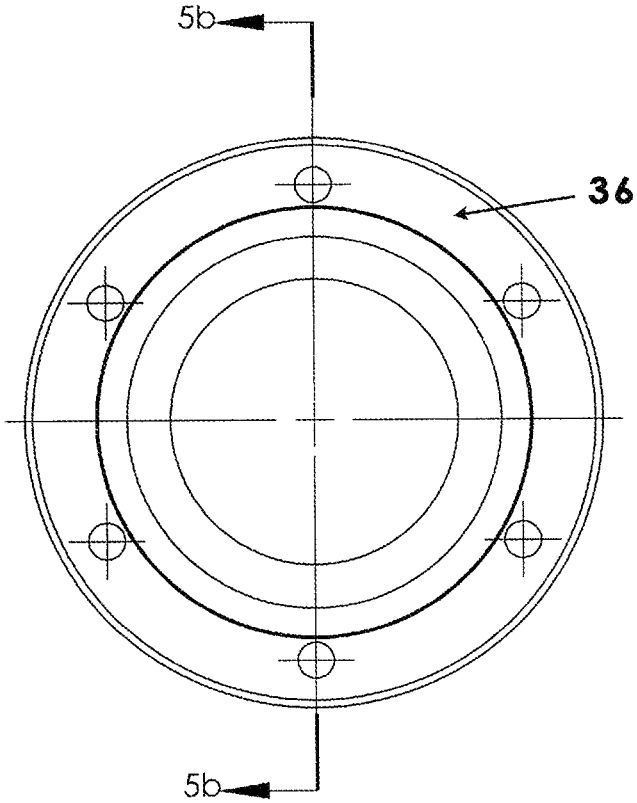
FIG. 5*a* is an end view of the adjustable diameter die assembly as in FIG. 2.

The workpiece (i.e., the tubing) being extruded) is pushed out of the cooling tank 60, such as by a mechanical ram or the like (not shown), via the outlet opening and into another adjustable diameter die assembly 10. More particularly, the die assembly 10 may include a die body adapter 36 having a cylindrical configuration with a plurality of spacers 37 extending away from an interior surface and defining a bore 38 therethrough having a diameter at least as large as that of the billet passing therethrough. The die body adapter 36 provides a framework for attachment of the remaining components of the adjustable diameter die assembly 10, including that the bore 38 has an inner diameter sufficient for nesting the die 20 therein (FIG. 5). The die body adapter 36 includes a back side opposite the plurality of spacers 37 that is configured to attach to a downstream end 64 of the cooling tank 60, the bore 38 defined by the die body adapter 36 being aligned or registered with the outlet opening of the cooling tank 60 through which the workpiece 100 passes.

Figure 5B:
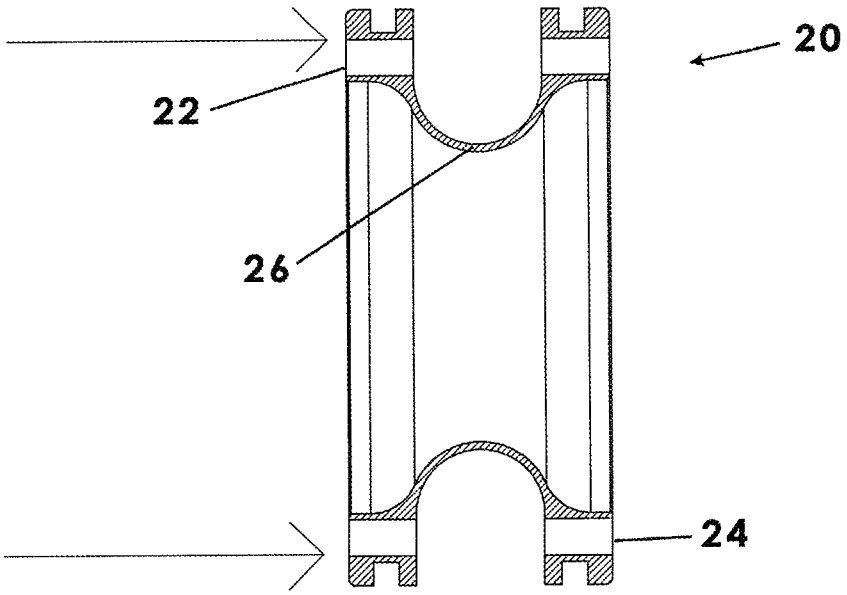
FIG. 5*b* is an isolated sectional view taken along line 5*b*-5*b* of FIG. 5*a;*

Next, reference is made to the adjustable die 20 itself which may be seated proximate to or inside the interior area defined by the bore 38 of the die body adapter 36. More particularly, the adjustable die 20 may have a first ring 22 and a second ring 24 that is concentric to and spaced apart from the first ring 22, the rings being connected by an axial portion 26 that defines a die bore having an inner diameter that is smaller than a diameter defined by either of the first and second rings 22, 24 (FIG. 5*b*). In an embodiment, each ring may include a pair of rims defining a recessed ring therebetween. It should be understood that the inner diameter defined by the axial portion 26 is the diameter that is adjustable/changeable when the first and second rings 22, 24 are compressed together or gently pulled apart as will be discussed further later. As in all extrusion designs, the workpiece (i.e., the material being formed/extruded) is forcibly pushed downstream through the adjustable die 20 by a ram, the workpiece then being reduced or enlarged in shape and diameter according to that of the adjustable die 20. This feature of the adjustable die 20 is critical and, in fact, is a major object of the present application.

The adjustable die 20 is coupled to a back end 29 of a die adapter 28, the back end 29 having a circular configuration and also defining a bore so as to be complementary to the adjustable die 20 and that allows the extruded material to continue its downstream movement. Further, the die adapter 28 includes a cylindrical front end 29*b* opposite the back end 29*a*. The die adapter 28 serves as an interface between the adjustable die 20 and the hydraulic portions of the adjustable diameter die assembly 10.

In an embodiment, the adjustable diameter die assembly 10 may include a hydraulic cylinder end plate 32 having a circular and thin configuration similar to a washer. The end plate 32, preferably, also defines a central opening 31 having a diameter that is large enough to enable the workpiece to pass therethrough. Further, the end plate 32 has a smooth face that defines a plurality of holes 33 that are spaced apart from one another and each aligned to register with corresponding openings 37*a* defined by said plurality of spacers 37, respectively, such that said hydraulic cylinder end plate 32 is coupled to said die body adapter 36. The end plate 32, therefore, provides stability to the assembly and also acts as a stop to operative movement of the hydraulic cylinder piston 40, as will be described below in more detail.

Figure 3:
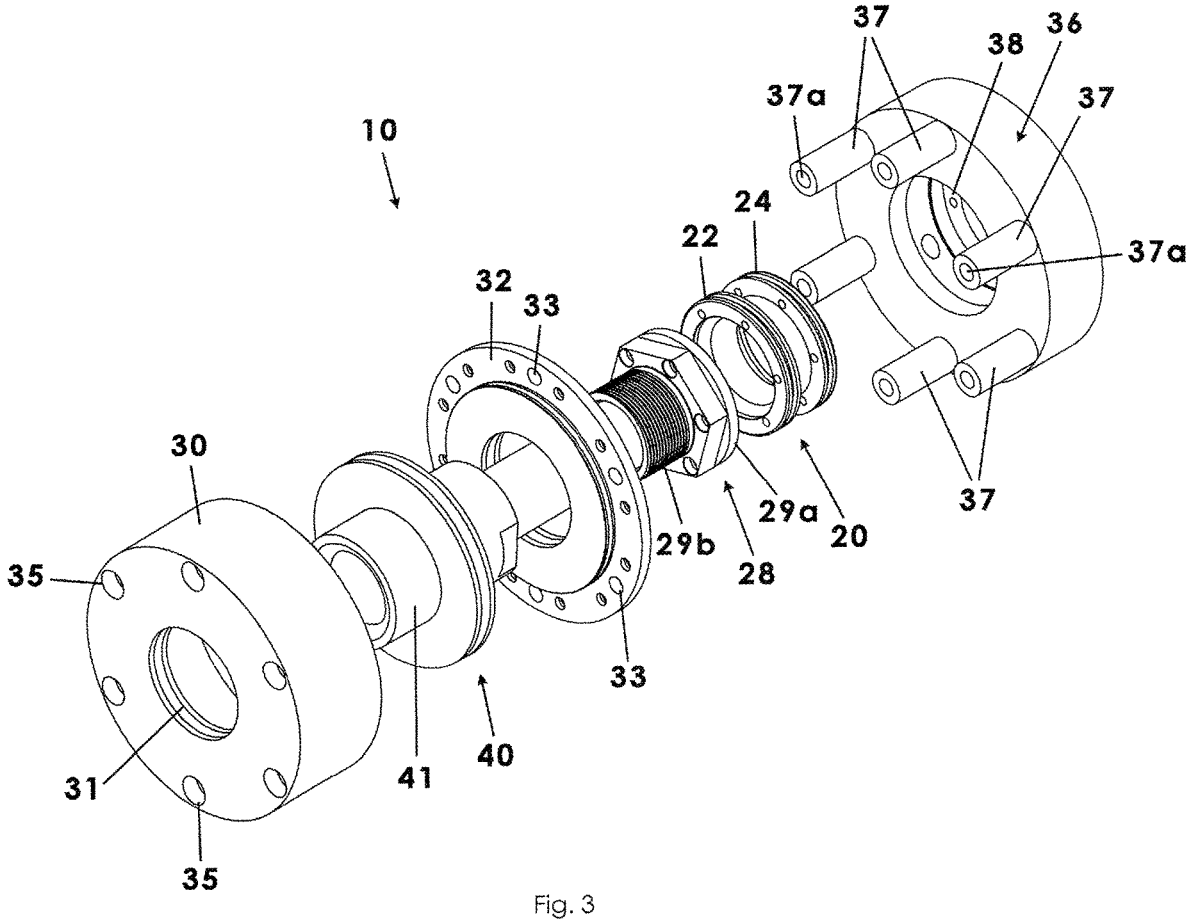
FIG. 3 is an exploded view of the adjustable diameter die assembly as in FIG. 2.
Figure 4A:
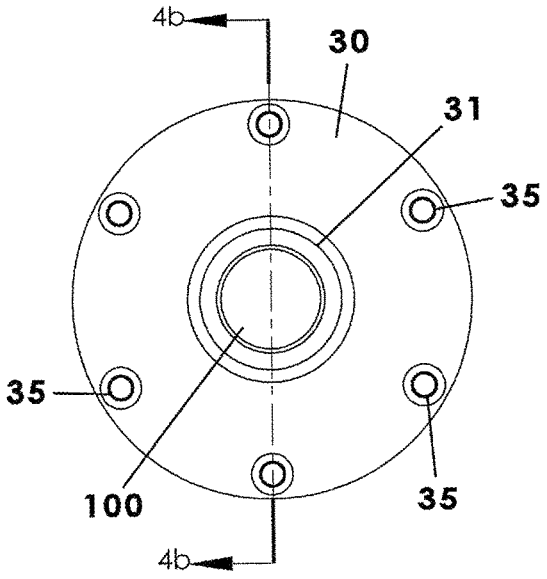
FIG. 4*a* is an end view of the adjustable diameter die assembly as in FIG. 2.
Figure 4C:
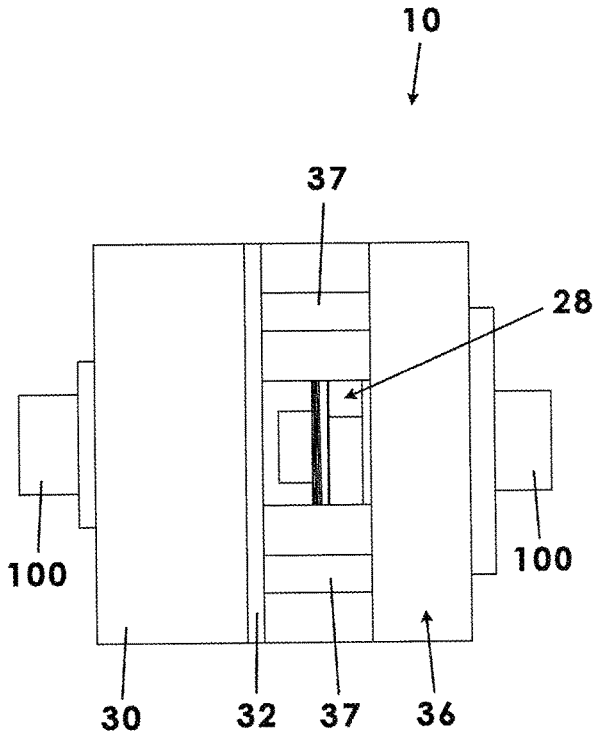
FIG. 4*c* is a side view of the adjustable diameter die assembly as in FIG. 2.
Figure 4B:
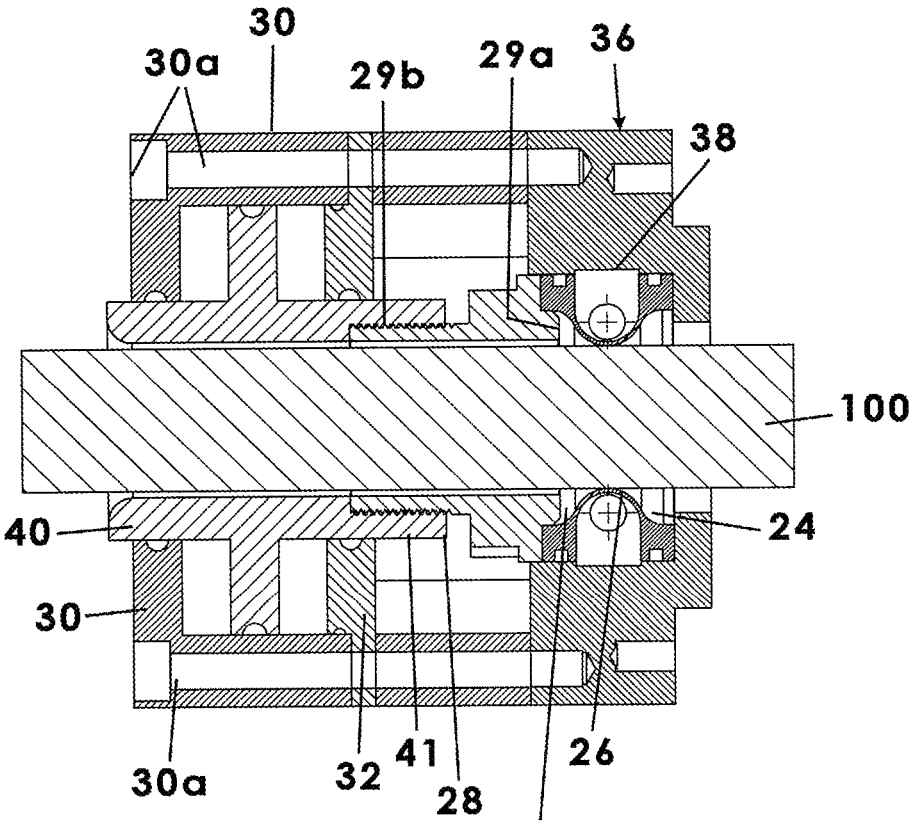
FIG. 4*b* is a sectional view taken along line 4*b*-4*b* of FIG. 4*a;*

Described now in greater detail, the adjustable diameter die assembly 10 includes a hydraulic cylinder housing 30 having a cylindrical configuration and defining a bore complementary to that of the adjustable die 20 so that the extruded workpiece may pass therethrough. The hydraulic cylinder housing 30 may be operatively connected to and in fluid communication with a hydraulic fluid system (not shown) whereby to be actuated thereby. The hydraulic cylinder housing 30 may be coupled to a hydraulic cylinder piston 40, the hydraulic cylinder piston 40 having a cylindrical front portion defining a throughbore and being sized to nest within the bore of the hydraulic cylinder housing 30. The hydraulic cylinder piston 40 may include a ram portion 41 configured to engage the die adapter 28. As described above in more detail, the hydraulic cylinder end plate 32 may be sandwiched between the hydraulic cylinder piston 40 and the die adapter 28 and has a diameter that is larger than either the hydraulic cylinder piston 40 or the die adapter 28 and is configured to provide leverage and stability when the hydraulic system is actuated (FIG. 3).

Hydraulic cylinders are used as linear actuators to apply unidirectional force and stroke: in other words, the hydraulic cylinder causes the piston to move in and out. Namely, the piston rod of a hydraulic cylinder transmits the power from the displacement of pressurized hydraulic fluid via the piston inside the cylinder shell. The cylinder gets its power from pressurized hydraulic fluid received from a hydraulic system and then uses that pressure to operate the hydraulic piston 40. As seen only in FIG. 2, the hydraulic cylinder housing 30 may include a pair of hydraulic fluid ports 39*a* 39*b*, each one configured for communicating with and receiving hydraulic fluid, wherewith to power the piston is a first longitudinal direction and a second longitudinal direction, respectively.

Figure 6A:
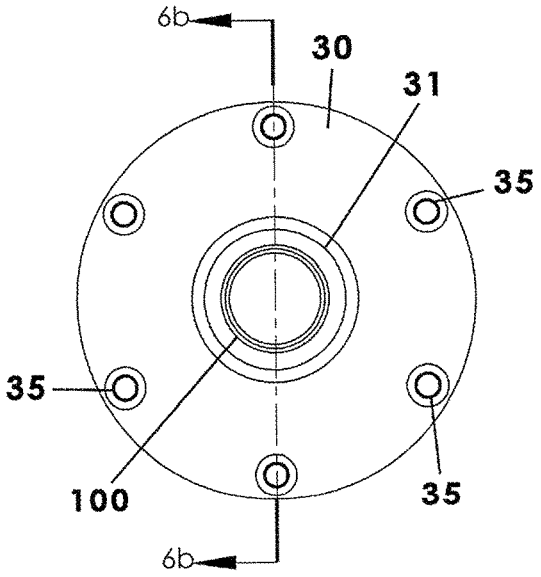
FIG. 6*a* is an end view of the adjustable diameter die assembly as in FIG. 2 according to another embodiment of the present invention.
Figure 6C:
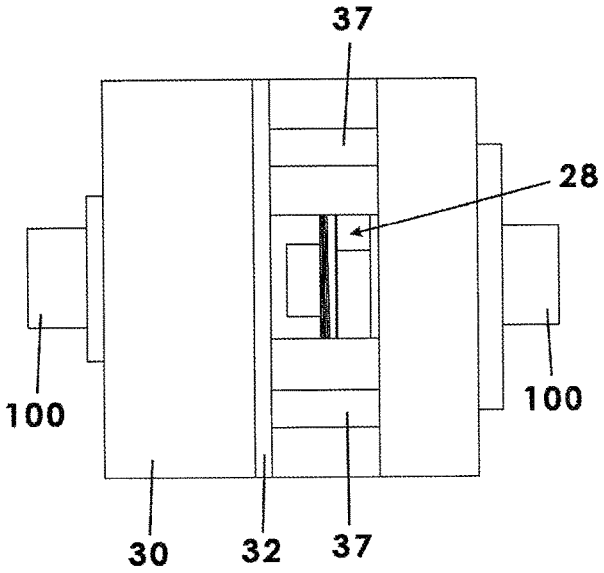
FIG. 6*c* is a side view of the adjustable diameter die assembly as in FIG. 6*a*.
Figure 6B:
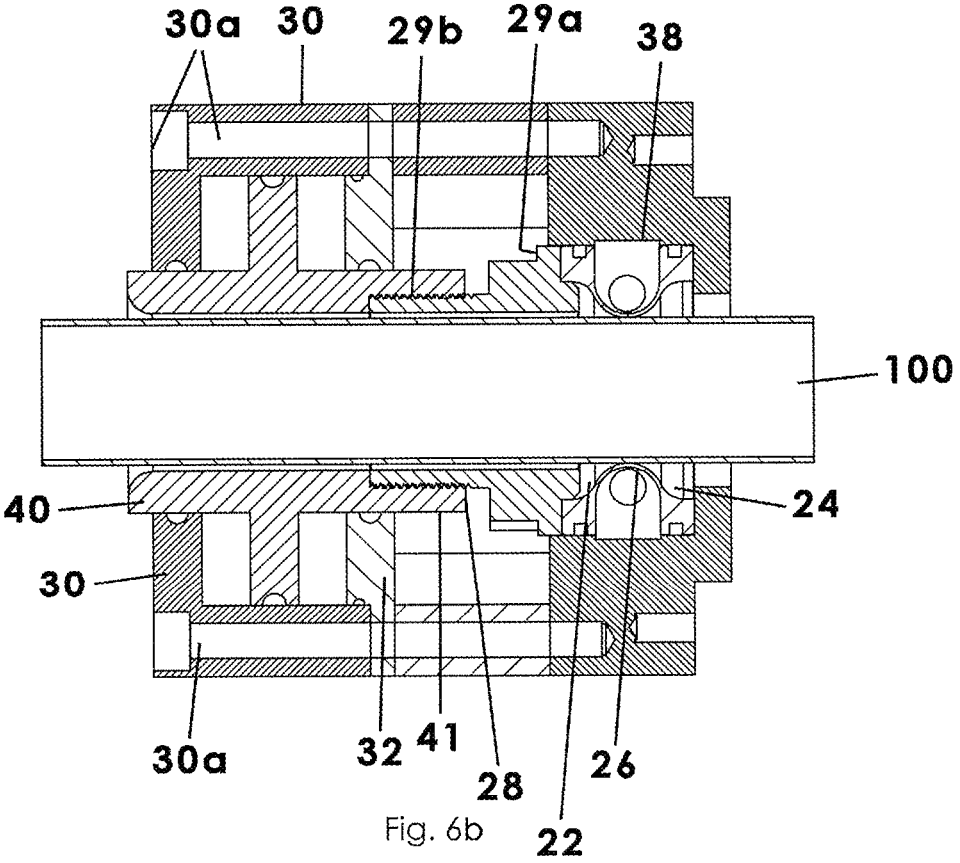
FIG. 6*b* is a sectional view taken along line 6*b*-6*b* of FIG. 6*a;*
Figure 7:
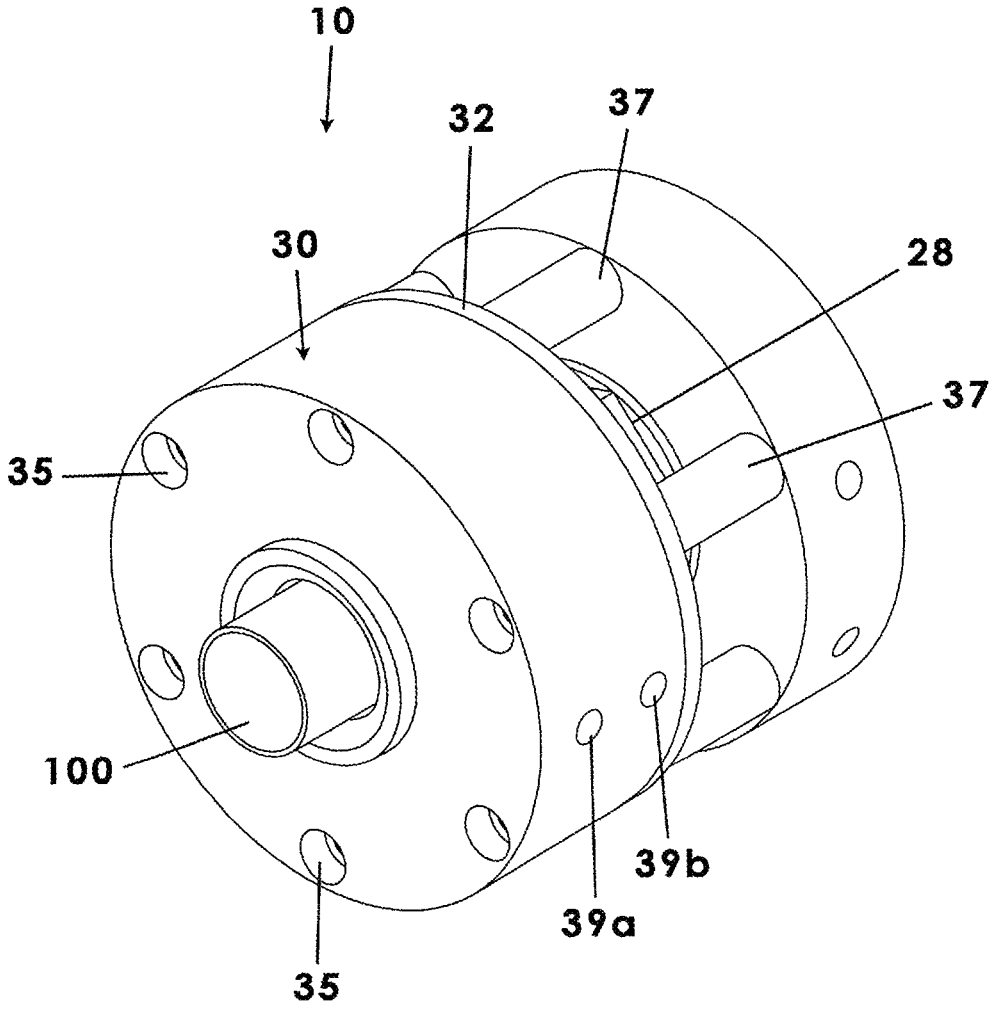
FIG. 7 is a perspective view of the adjustable diameter die assembly and associated tooling including a hydraulically actuated piston and the material as a hollow tube being extruded according to one embodiment of the present invention.

When actuated by hydraulic fluid operation flowing to a first cylinder port 39*a*, the hydraulic piston 40 is operative to apply pushing pressure on the rings 22, 24 of the adjustable die 20. It will be understood that a pushing pressure, i.e., a squeezing together of the first and second rings 22, 24 decreases the axial diameter of the adjustable die 20 (FIG. 6*b*). Conversely, when actuated by hydraulic fluid flowing to a second cylinder port 39*b*, the piston 40 moves in an opposite direction imparting a pulling apart of the first and second rings 22, 24 such that the axial diameter of the adjustable die 20 is increased/enlarged. Explained in yet another way, pressurized hydraulic fluid inserted into one port displaces pressurized fluid in another port so as to actuate the piston 40 in an opposite direction. Actuation of hydraulic fluid flow may occur via manual activation or according to sensor data or a predetermined algorithm, respectively.

In an embodiment, the hydraulic cylinder housing 30 may be adapted to operate using a mechanical screw and motor or other means of actuation as an alternative to the hydraulic system described above. The hydraulic cylinder housing 30 may define a plurality of apertures 35 that are spaced apart radially from one another and each in communication with associated longitudinal fastener channels.

In use, the adjustable diameter die assembly 10 described above may be installed as an alternative to traditional die assemblies used for metal extrusions. By contrast to a traditional die with a fixed diameter, the adjustable die 20 has an operative connection to a hydraulic system enables a diameter of the adjustable die 20 and, consequently, a diameter associated with the billet or as may be referred to as the aluminum or metal workpiece may be selectively increased or decreased with hydraulically induced pressure or relaxation, respectively.

It is understood that while certain forms of this invention have been illustrated and described, it is not limited thereto except insofar as such limitations are included in the following claims and allowable functional equivalents thereof.

The invention claimed is:

1. An adjustable diameter die assembly for extruding a heated and malleable workpiece being forcefully moved downstream, comprising:

a die having a first ring and a second ring spaced apart from said first ring, said die having an axial portion extending intermediate the first and second rings that defines a throughbore having an axial diameter that is adjustable;

a piston/cylinder combination operatively coupled to the die that, when actuated, causes (1) a compression of said first and second rings toward one another such that said axial diameter is decreased or (2) a stretching of said first and second rings away from one another such that said adjustable axial diameter is adjusted, respectively;

a die body adapter having a cylindrical configuration and having a plurality of spacers that are spaced apart from one another; and a hydraulic cylinder end plate having a circular configuration defining a central bore having a diameter greater than the diameter of the workpiece, said hydraulic cylinder end plate defining a plurality of holes that are spaced apart from one another and each aligned to register with corresponding openings defined by said plurality of spacers, respectively, such that said hydraulic cylinder end plate is coupled to said die body adapter.

2. The adjustable diameter die assembly as in claim 1, wherein said throughbore defined by said die extrudes the workpiece according to the axial diameter when the workpiece is forcefully moved downstream through the throughbore of said die.

3. The adjustable diameter die assembly as in claim 1, wherein said die is nested in said bore of said die body adapter.

4. The adjustable diameter die assembly as in claim 1, wherein said piston/cylinder combination comprises:

a hydraulic cylinder housing in fluid communication with a hydraulic system for receiving pressurized fluid; and a hydraulic piston coupled to said hydraulic cylinder housing and operative to move linearly in or out relative to said hydraulic housing, respectively, when actuated by said received pressurized fluid;

wherein said hydraulic piston includes a ram portion operatively bearing against the adjustable die and is configured so as to cause said compression or said stretching, respectively, when said hydraulic piston is actuated.

5. An adjustable diameter die assembly for extruding a heated and malleable workpiece being forcefully moved downstream, comprising:

an adjustable die having a first ring and a second ring and an axial portion extending between the first and second rings that defines a throughbore defining an axial diameter; and a piston/cylinder combination operatively coupled to the adjustable die that, when actuated, causes (1) a tightening, of said first and second rings toward one another such that said axial diameter is decreased or (2) a relaxing of said first and second rings away from one another such that said axial diameter is increased, respectively;

a die body adapter having a cylindrical configuration and having a plurality of spacers that are spaced apart from one another and defining a bore therethrough having a diameter at least as large as a diameter of the workpiece being moved downstream;

a hydraulic cylinder end plate having a circular configuration defining a central bore having a diameter greater than the diameter of the workpiece, said hydraulic cylinder end plate defining a plurality of holes that are spaced apart from one another and each aligned to register with corresponding openings defined by said plurality of spacers, respectively, such that said hydraulic cylinder end plate is coupled to said die body adapter;

wherein said throughbore defined by said adjustable die extrudes the workpiece according to the axial diameter when the workpiece is forcefully moved downstream through the throughbore of said adjustable die.

6. The adjustable diameter die assembly as in claim 5, wherein said adjustable die is nested in said bore of said die body adapter.

7. The adjustable diameter die assembly as in claim 5, wherein said piston/cylinder combination comprises:

a hydraulic cylinder housing in fluid communication with a hydraulic system for receiving pressurized fluid; and a hydraulic piston coupled to said hydraulic cylinder housing and operative to move linearly in or out relative to said hydraulic housing, respectively, when actuated by said received pressurized fluid;

wherein said hydraulic piston includes a ram portion operatively bearing against the adjustable die and is configured so as to cause said compression or said stretching, respectively, when said hydraulic piston is actuated.

* * * * *